US006006526A

United States Patent [19]

Nilsson

[11] Patent Number: 6,006,526

[45] Date of Patent: Dec. 28, 1999

[54] METHOD AND APPARATUS FOR MAKING ARTIFICIAL SNOW

[75] Inventor: Lennart Nilsson, Östersund, Sweden

[73] Assignee: Lenko L Nilsson, Ostersund, Sweden

[21] Appl. No.: 09/077,109

[22] PCT Filed: Oct. 1, 1996

[86] PCT No.: PCT/SE96/01229

§ 371 Date: May 22, 1998

§ 102(e) Date: May 22, 1998

[87] PCT Pub. No.: WO97/26493

PCT Pub. Date: Jul. 24, 1997

[30] Foreign Application Priority Data

Jan. 15, 1996 [SE] Sweden ..... 9600122

[51] Int. Cl.[6] ..... F25C 3/04

[52] U.S. Cl. ..... 62/74; 62/347; 239/2.2

[58] Field of Search ..... 62/74, 347, 121, 62/314; 239/2.2, 14.2

[56] References Cited

U.S. PATENT DOCUMENTS

| | | | |
|---|---|---|---|
| 3,301,485 | 1/1967 | Tropeano et al. | 62/347 |
| 3,969,908 | 7/1976 | Lawless et al. | 62/74 |
| 4,202,496 | 5/1980 | VanderKelen et al. | 62/121 |
| 4,682,729 | 7/1987 | Doman et al. | 239/14.2 |
| 5,810,249 | 9/1998 | Nilsson | 239/2.2 |

FOREIGN PATENT DOCUMENTS

| | | |
|---|---|---|
| 393 318 | 9/1991 | Austria . |
| 94/03764 | 7/1972 | WIPO . |
| 96/095505 | 3/1996 | WIPO . |

OTHER PUBLICATIONS

Patent Abst. Of JP, vol. 14, No. 22, M–973, abst of JP, A, 2–5877 (Ebara Corp.) Feb. 27, 1990.

*Primary Examiner*—William E. Tapolcai
*Attorney, Agent, or Firm*—Larson & Taylor

[57] ABSTRACT

A method and an apparatus for making artificial snow with a snow-making machine having a funnel-shaped carrier. The carrier has, at the inlet end thereof, a fan adapted to provide rapid flow of air through the carrier, and at the outlet end thereof, both a ring of atomizing nozzles mounted close to a nose cone of the snow-making machine, and several (preferably three or more) rings of water distribution nozzles. The water nozzles are arranged to eject a curtain of water drops obliquely into the flow of air passing through the carrier. The method involves the steps of: (a) turning on the fan so that a rapid flow of air is moved through the snow-making machine, (b) pressing water under high pressure through the ring of atomizing nozzles, (c) then turning on pressurized water in a first ring of water distribution nozzles, and (d) thereafter, stepwise after each other, turning on pressurized water to the remaining rings of water distribution nozzles.

10 Claims, 2 Drawing Sheets

METHOD AND APPARATUS FOR MAKING ARTIFICIAL SNOW

FIELD OF THE INVENTION

The present invention generally relates to making artificial snow by means of a snow making machine, and more particularly to a funnel shaped carrier which at one end thereof, the inlet end, has a fan blowing a large amount of air there through under high pressure and at high speed, and which at its other end is formed with several rings having a large number of fine distribution (atomizing) nozzles through which water under high pressure is ejected into the air flow passing through the carrier, and whereby the pressure for atomizing the water into small drops can be 30–40 bar. For making said small drops of water become frozen, strongly frozen particles, so called nuclei, are introduced into the flow of water drops, which is referred to as the bulk water flow. These nuclei, which have as low a temperature as down to 42° C., act as a type of catalyst for freezing the water drops emanating from the ordinary water nozzles. The nuclei are created at a place where the air flow has its lowest air speed, in particular at a "back zone" adjacent the nose cone of the funnel shaped carrier at which zone there is a low air speed.

BACKGROUND OF THE INVENTION

In our Swedish patent No 9403168-9 (equivalent to WO 96/09505 and U.S. Pat. No. 5,810,249), there is described how to make snow crystals in two steps. In a first step, nuclei are created in the outer periphery of the air flow, in that extremely fine drops of water are sprayed through atomizing nozzles of the back zone of the nose cone. In a second step, the nuclei are mixed and thereby formed with atomized water drops which are ejected into the air flow passing through the snow making machine from the ordinary water nozzles of the snow making machine, thereby forming a plume of water drops which are mixed with the nuclei in a turbulent air flow.

A problem has been that a part of the water drops which is ejected from the nozzles falls to the ground in an only partly frozen or even non-frozen condition thereby forming an unwanted layer of ice on the ground. This problem is increasingly noticeable the higher the temperature of the ambient air is. Until now it has not been possible, in practice, to make artificial snow if the temperature of the ambient air is higher than about −3° C. to −2.5° C., and even at such theoretically possible temperatures of the ambient air there have been problems to freeze all water drops ejected from the water nozzles. In many cases it has not been considered practically and economically possible to make artificial snow at higher temperatures than −3° C. to −4° C.

For having the water drops distributing themselves in an optimum way in the air flow of the snow making machine, and for having the snow making machine produce the greatest possible amount of snow crystals, it has been shown suitable to form the snow making machine with several rings of water distribution nozzles arranged axially on line after each other adjacent the outlet end of the snow making machine. Today there are generally used at least three nozzle rings, and even as much as six nozzle rings.

BRIEF SUMMARY OF THE INVENTION

It has shown that it is of great importance to the formation of snow crystals how the nozzles of the rings are placed, and according to the invention the nozzles of the various nozzle rings are mounted angularly with a successively steeper (less) angle to the flow axis as seen in the flow direction. In a preferred embodiment of the invention, which is illustrated in the accompanying drawings, the snow making machine is formed with a ring of nuclei nozzles mounted close to the nose cone of the snow making machine, especially at the above mentioned back zone, and five rings of ordinary water nozzles. The rearmost ring of nuclei nozzles has the most blunt (greatest) angle to the flow axis, and the foremost ring has the steepest (smallest) angle to the flow axis. As an example, it can be suggested that the nozzles of the rearmost ring are mounted at an angle of about 45°, and that the nozzles of the succeeding rings can be mounted at angles of about 42°, 37°, 32° and 27°, respectively. The nuclei nozzles can be mounted at an angle of about 30° to the axis of the air flow through the snow making machine.

Surprisingly, it has been shown that it is possible to use the snow making machine for making snow crystals having a good quality at lower temperatures than has so far been considered possible. This is accomplished where the water of the various nozzle rings is turned on at stages, and still better according to a specific order of stages. In the illustrated embodiment, in which the nozzles of the various rings are mounted at successively steeper angles to the flow axis, it has been shown particularly suitable that the water is first turned on in the foremost ring but one, ring II as shown in the drawings, thereafter in the rings II+I, followed by rings II+I+III, the rings II+I+III+IV and in all rings II+I+III+IV+V. The water to the atomizing nozzles which create the nuclei is constantly turned on after the air flow through the snow making machine has been turned on.

By this way of starting and proceeding with the making of snow crystals, it has been possible to make snow crystals having a good quality and being almost completely frozen throughout at temperatures of the ambient air of even up to +5° C. This is true at very dry air conditions, for instance air having a moisture content of about 20%; but also at higher moisture contents, the invention offers the possibility of making snow crystals at surprisingly high ambient temperatures. The increase of the ambient temperature at which it is possible to make snow crystals of good quality from the previously highest possible temperature level of at least −3° C. to −1° C. is very important considering the fact that the snow making machine may thereby be used on many occasions on which it has previously not been possible to artificially make snow crystals of good quality having completely frozen through water drops.

In the preferred embodiment of the invention which is shown in the accompanying drawings, and which is formed with five nozzle rings, it has been possible to reach the following capacity at a water pressure of 35 bar:

| | |
|---|---|
| ring II | 140 l/minute |
| rings II + I | 264 l/minute |
| rings II + I + III | 396 l/minute |
| rings II + I + III + IV | 538 l/minute |
| rings II + I + III + IV + V | 659 l/minute. |

It is not completely made clear what is the reason for the good effect of stage wise turning on the water of the nozzle rings in the above order. It is believed that the reason for this is that the separation of the water drops from the nozzles is increased, and that a compact cold mass body is successively built up in the snow making machine following the turning on the various nozzle rings. This cold mass body, after having been filly built up, makes it possible to completely freeze practically all water drops from all nozzle rings—even when all nozzle rings operate at full capacity.

BRIEF DESCRIPTION OF THE DRAWINGS

Now the invention is to be described more in detail with reference to the accompanying drawings which diagrammatically show a preferred embodiment of a snow making machine according to the invention.

DETAILED DESCRIPTION OF THE INVENTION

Figure 1:
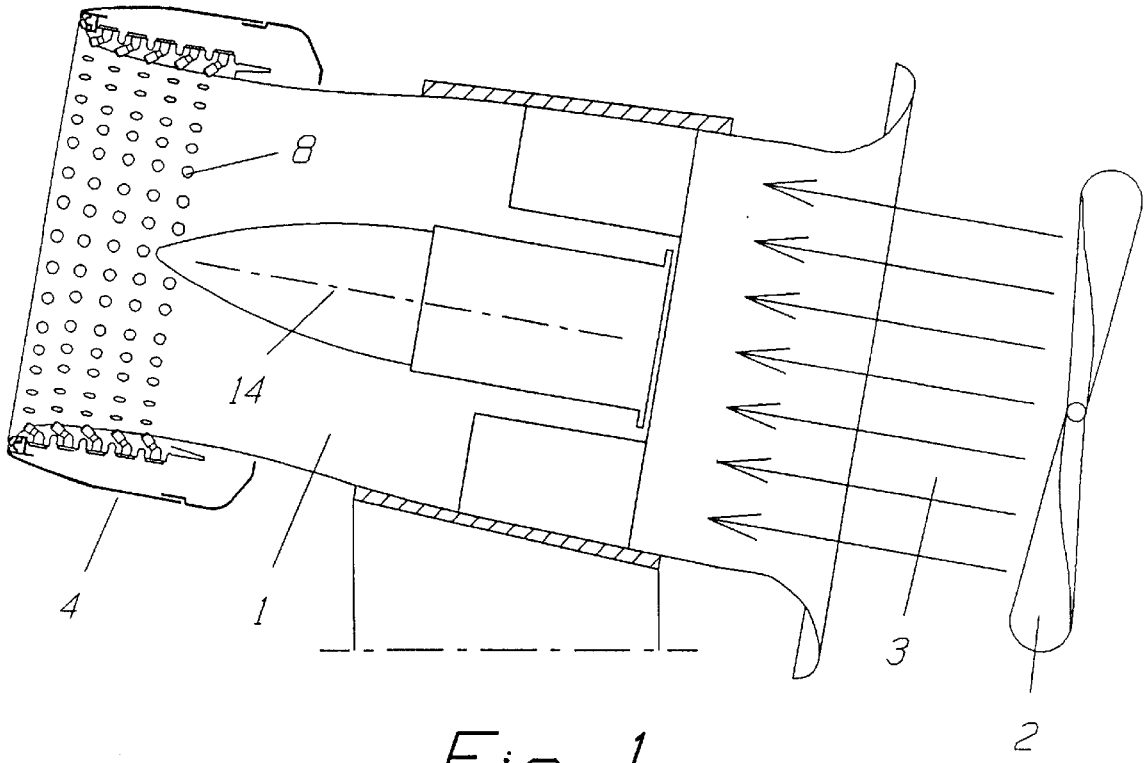
FIG. 1 shows an axial cross section view through a snow making machine having one ring of atomizing nozzles and five rings of ordinary water nozzles arranged successively following each other in the axial direction.
Figure 2:
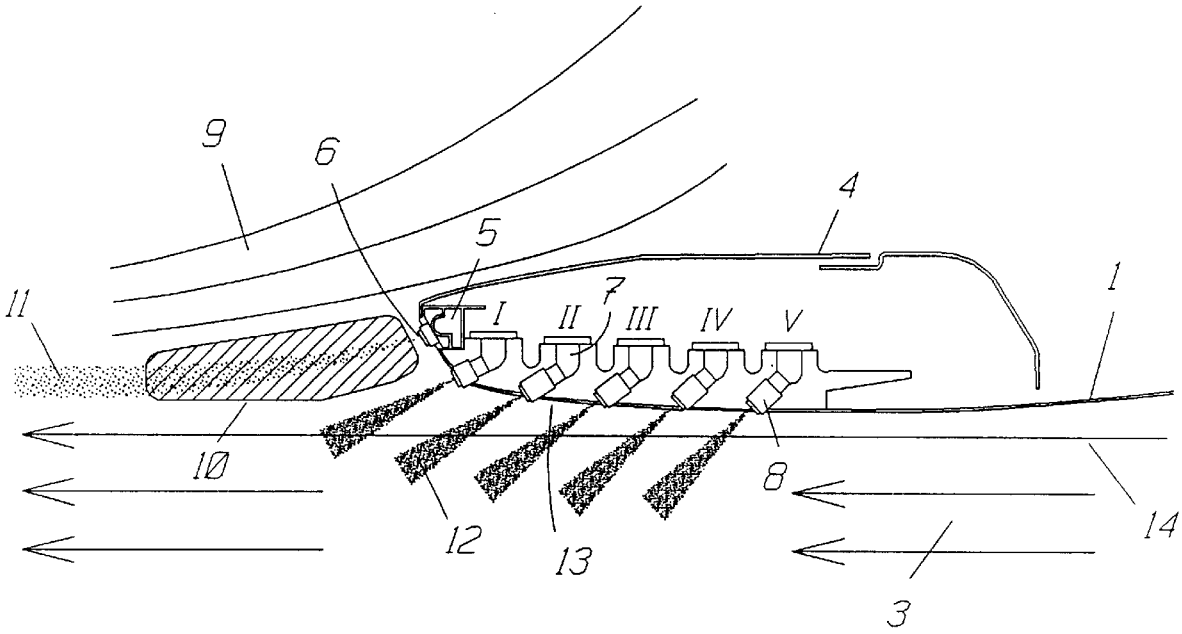
FIG. 2 is a cross section view through the nozzle rings in the snow making machine of FIG. 1.

As is conventional, the snow making machine shown in the drawings comprises a funnel shaped carrier 1. Carrier 1 at the inlet end thereof is formed with a diagrammatically sketched fan 2 forcing a flow of air 3 through the carrier 1, and at the outer end thereof is formed with a nose cone 4 of suitable shape and size. Nose cone 4 carries both a ring 5 having a series of atomizing nozzles 6 distributed round the carrier 1, and five rings 7, marked I–V, having a large number of ordinary water distribution nozzles 8 mounted peripherally round the carrier 1.

The nose cone 4 is formed so that the air flow 3 through the snow making machine, in combination with the flow 9 of ambient air which is induced by a suction action past the nose cone 4 at the outlet end thereof, forms a "back zone" 10 having a low air speed. In back zone 10 there is a sub pressure which makes the atomized water drops from the atomizing nozzles 6 become converted to strongly frozen nuclei 11. Nuclei 11 distribute in a ring comprising the strongly cooled down, and extremely finely atomized nuclei, around the air flow. The nuclei 11 act as catalysts which speed u and facilitate the freezing of the water particles 12 which are ejected through the ordinary water distribution nozzles 8 and which mix with the nuclei 11.

Figure 3:
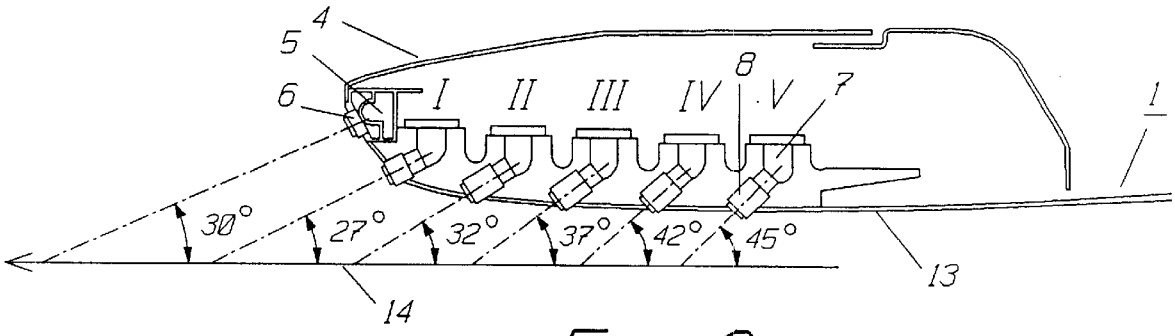
FIG. 3 is a cross section view similar to that of FIG. 2, and it illustrates the placing and the angular positioning of the nozzles.

The water nozzles 7 are mounted similarly to form a diverging cone or arc 13 so that the foremost nozzle ring 1 has a greater diameter than the rings II–V mounted successively rearwardly thereof The rearmost ring V has the smallest diameter. As best evident from FIG. 3, the nozzles 7 are mounted at different angles in relation to the flow axis 14 of the snow making machine. The nozzles 7 are preferably mounted at successively less angles, as seen in the flow direction, for instance so that the nozzles of the rearmost ring V forms an angle to the flow axis of about 45°, the nozzles IV an angle of about 42°, the nozzles III an angle of about 37°, the nozzles II an angle of about 32°, and the nozzles I an angle of about 27°. The atomizing nozzles 6 preferably can be mounted at an angle of about 30° to the flow axis 14.

In case of very cold ambient air, all water rings I–V can be pressurized at the same time with water having a pressure of about 35 bar. At marginal temperatures of the ambient air of between −2° C. and ±0° C. there are, however, problems to provide a freezing of all water drops 12 ejected from the nozzles 8. At still higher temperatures, for instance temperatures as high as +4 to +5° C., it has until now been very difficult, if at all possible, E to make artificial snow.

According to the invention there is used a method according to which the water distribution rings are, for this reason, pressurized in turn after each other. In particular, the outermost ring but one is pressurized first, whereafter the succeeding rings are pressurized in turn after each other in combination with the previously pressurized ring/rings, that is I, III, IV and V. By this method there is obtained a surprisingly effective freezing of the water drops, and thereby it is possible to make artificial snow even at temperatures of up to −2° C. to ±0° C.; and if the humidity of the ambient air is low at temperatures of up to +4° C. to +5° C.

Figure 4A:
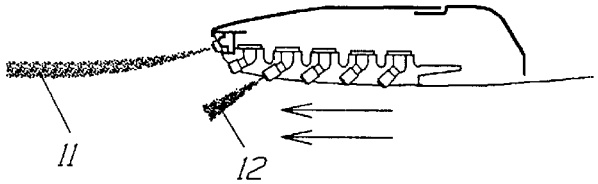
FIGS. 4A–E shows in five successive views the optimum way, according to the invention, of operating the snow making machine at marginal temperatures of the ambient air of about −2° C. and at such high temperatures as up to +4° C. to +5° C.
Figure 4B:
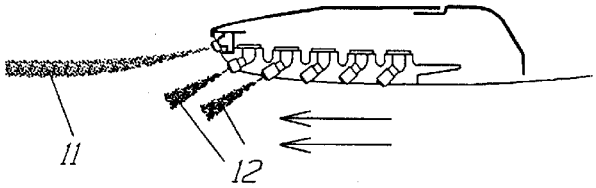
Figure 4C:
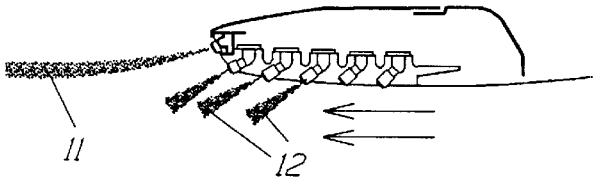
Figure 4D:
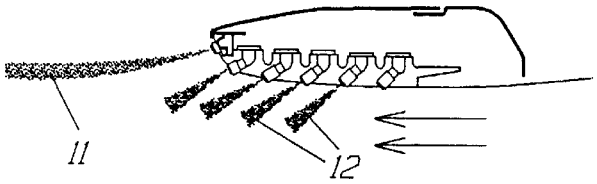
Figure 4E:
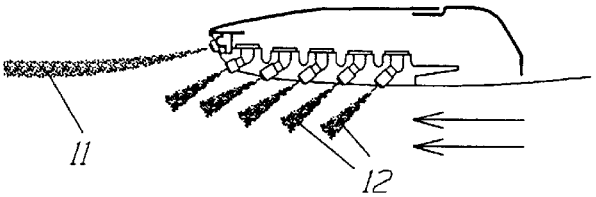

The method is performed in the following way:

the fan 2 is started whereby a flow of air 3 having high speed is moved through the carrier 1, which flow of air brings a flow 9 of ambient air at the exterior side of the snow making machine;

pressurized water is turned on to the ring 5 of atomizing nozzles 6, whereby extremely finely atomized drops of water are ejected into the back zone 10 which is formed at the outlet side of the nose cone 4; by the action of the air flow 3 and the flow 9 of ambient air brought by air flow 3, there is formed a sub pressure in the back zone which contributes to making the extremely finely atomized water drops from the nozzle become very strongly cooled down (frozen) and forming an all around extending curtain of nuclei;

pressurized water is turned on to the outermost but one ring II of water nozzles 8 (see FIG. 4A), whereby a flow 12 of water drops is ejected into the air flow 3, in the illustrated case preferably an average angle of about 32°;

when the water flow from the ring II has stabilized, so that the water drops form a body of frozen snow crystals, pressurized water is turned on in the ring I (see FIG. 4B); and when also the flow has stabilized, the rings III, IV and V (see FIGS. 4C, 4D and 4E) are turned on so that the snow making machine ultimately provides a total mass of well frozen snow crystals.

It is obvious that the invention is well useful in snow making machines formed with only three or four rings of water nozzles. It is also obvious that the water nozzles can be mounted at other angles than those mentioned above, and that each of the suggested angles is only one out of many possible examples. It is, however, important that the nozzles of the various nozzle rings are mounted at successively steeper (less) angles to the flow axis 14 of the snow making machine, as seen in the flow direction.

I claim:

1. A snow making apparatus comprising:

a funnel shaped carrier having an inlet end and an outlet end;

a fan located at said inlet end of said carrier which causes a rapid flow of air through said carrier from said inlet end to said outlet end along a flow axis;

a ring of atomizing nozzles located at said outlet end of said carrier;

at least three rings of water distribution nozzles mounted at said outlet end but inside of said ring of atomizing nozzles, each said ring of water nozzles ejecting a curtain of water drops into the flow of air passing through said carrier and being separately pressurized to eject the water drops, and wherein the water nozzles of each said ring are mounted at successively smaller angles relative to the flow axis in the flow direction.

2. A snow making apparatus as claimed in claim 1:

wherein there are at least four of said rings of water nozzles arranged axially following one another; and wherein said rings of water nozzles have successively larger diameters and are mounted to form a successively widened cone shape, as seen in the flow direction.

3. A snow making apparatus as claimed in claim 1:

wherein said water nozzles of an innermost said ring are mounted at an angle of about 45°; and wherein said water nozzles of an outermost said ring are mounted at an angle of about 27°.

4. A snow making apparatus as claimed in claim 1:

wherein there are five of said rings of water nozzles arranged axially following one another; and wherein said water nozzles of said five rings are successively mounted beginning at a innermost ring at respective angles of about 45°, 42°, 37°, 32°, and 27°.

5. A method for making artificial snow with a snowmaking machine having (a) a funnel shaped carrier having an inlet end and an outlet end, (b) a fan located at the inlet end of the carrier, (c) a ring of atomizing nozzles located at the outlet end of the carrier, and (d) at least three rings of water distribution nozzles mounted at the outlet end but inside of the ring of atomizing nozzles, the method comprising the steps of:

situating each ring of water nozzles to eject a curtain of water drops into a flow of air passing through the carrier when each ring is separately pressurized to eject the water drops; said situating step including arranging the water nozzles of each ring to be mounted at successively smaller angles relative to a flow axis of the flow of air in a flow direction;

turning on the fan to cause a rapid flow of air through the carrier from the inlet end to the outlet end along a flow axis and the flow direction;

thereafter ejecting water under high pressure through the ring of the atomizing nozzles;

thereafter first ejecting water from a selected ring of the at least three rings of water nozzles to produce snow crystals; and thereafter next ejecting water from the other rings of water nozzles one after the other to produce additional snow crystals.

6. A method for making artificial snow as claimed in claim 5;

wherein said first ejecting water step includes the steps of providing pressurized water when ambient temperatures are more than −5° to −2° C., and selecting an outermost but one ring of water nozzles as the selected ring from which water is first ejected; and wherein said next ejecting water step includes the steps of ejecting water from an outermost ring of water nozzles after snow crystal production has stabilized in the outermost but one ring, and then from successive inward rings of water nozzles from the outermost but one ring after snow crystal production from a previous ring of water nozzles has stabilized.

7. A method for making artificial snow as claimed in claim 6;

wherein said first ejecting water step includes the steps of providing pressurized water when ambient temperatures are more than −2° to +4–5° C.

8. A method for making artificial snow as claimed in claim 5 wherein each ring of water nozzles ejects about the same amount of water.

9. A method for making artificial snow as claimed in claim 8, where the amount of water ejected by each ring of water nozzles is about 140 l/minute at a pressure of about 35 bar.

10. A method for making artificial snow as claimed in claim 5 and further including the step of arranging the ring of atomizing nozzles to be mounted in a nose cone of the snowmaking machine so that extremely finely atomized water drops from the atomizing nozzles are ejected into a back zone of the flow of air having a low air speed, in which zone the water drops provide a curtain of strongly frozen nuclei.

* * * * *